US011118361B2

(12) United States Patent
Starrett

(10) Patent No.: US 11,118,361 B2
(45) Date of Patent: Sep. 14, 2021

(54) TELESCOPING SLEEVE ASSEMBLY WITH LOCKING COMPONENTS

(71) Applicant: Riley Starrett, Edmonton (CA)

(72) Inventor: Riley Starrett, Edmonton (CA)

(73) Assignee: STARRETT CONSTRUCTION SOLUTIONS INC., Edmonton (CA)

( * ) Notice: Subject to any disclaimer, the term of this patent is extended or adjusted under 35 U.S.C. 154(b) by 0 days.

(21) Appl. No.: 16/999,796

(22) Filed: Aug. 21, 2020

(65) Prior Publication Data

US 2021/0054639 A1 Feb. 25, 2021

Related U.S. Application Data

(60) Provisional application No. 62/890,702, filed on Aug. 23, 2019.

(51) Int. Cl.

| | |
|---|---|
| ***E04G 17/065*** | (2006.01) |
| ***E04G 17/075*** | (2006.01) |
| ***E04G 17/06*** | (2006.01) |
| ***E04G 15/06*** | (2006.01) |

(52) U.S. Cl.

CPC ..... *E04G 17/06* (2013.01); *E04G 15/061* (2013.01); *E04G 17/0642* (2013.01); *E04G 17/0651* (2013.01); *E04G 17/0752* (2013.01)

(58) Field of Classification Search

CPC . E04G 17/0642; E04G 17/06; E04G 17/0651; E04G 17/0714; E04G 17/0752

USPC ..... 249/43

See application file for complete search history.

(56) References Cited

U.S. PATENT DOCUMENTS

| | | | | |
|---|---|---|---|---|
| 1,951,754 | A * | 3/1934 | Gilbert | F21V 21/22 403/108 |
| 2,072,791 | A * | 3/1937 | Baer | A47B 91/12 248/407 |
| 2,411,678 | A | 11/1946 | Cornella | |
| 3,179,071 | A * | 4/1965 | Johnston | A47B 9/14 108/147.2 |
| 3,523,552 | A | 8/1970 | Ogden | |
| 4,079,912 | A | 3/1978 | Haydock | |
| 4,598,519 | A * | 7/1986 | Reid | E04B 2/8647 249/216 |
| 4,625,940 | A | 12/1986 | Barton | |
| 5,405,119 | A | 4/1995 | Maguire | |
| D377,143 | S | 1/1997 | Schnabel | |

(Continued)

FOREIGN PATENT DOCUMENTS

| | | | |
|---|---|---|---|
| CA | 2984051 | C | 5/2020 |
| WO | 2011066952 | A1 | 6/2011 |

*Primary Examiner* — Michael Safavi

(74) *Attorney, Agent, or Firm* — Christensen O'Connor Johnson Kindness PLLC

(57) ABSTRACT

A sleeve assembly is provided comprising an inner tubular member and at least one outer sleeve that receives at least a portion of the inner tubular member. The outer sleeve may longitudinally telescope with the inner tubular member to move between a non-expanded position and at least one expanded position. In some embodiments, the inner tubular member comprises a first locking component and the at least one outer sleeve comprises a second locking component that interlocks with the first locking component to secure the outer sleeve in the non-expanded position and/or at least one expanded position. Related methods for making a sleeve assembly are also provided.

20 Claims, 12 Drawing Sheets

(56) References Cited

U.S. PATENT DOCUMENTS

| | | | | |
|---|---|---|---|---|
| 5,813,185 | A | 9/1998 | Jackson | |
| 6,837,473 | B2 | 1/2005 | Petkau | |
| 2004/0011943 | A1* | 1/2004 | Long, Sr. ..... | E04G 17/06<br>249/216 |

* cited by examiner

TELESCOPING SLEEVE ASSEMBLY WITH LOCKING COMPONENTS

RELATED APPLICATION

The present disclosure claims priority to U.S. Provisional Patent Application No. 62/890,702, filed Aug. 23, 2019, the entire contents of which are incorporated by reference herein.

TECHNICAL FIELD

The present disclosure relates to apparatuses used in building construction. More particularly, the present disclosure relates to sleeve assemblies used in the manufacture of concrete structures.

BACKGROUND

Concrete structures may be manufactured on site by pouring concrete into temporary or permanent molds known as "formwork". Concrete walls may be made by pouring concrete between two opposed formwork panels. The panels may be secured to one another by a plurality of transverse tie rods that hold the panels straight and in-line. The tie rods may have threaded ends that project from the exterior of the formwork panels to be secured by corresponding wing nuts or any other suitable securing means. Once the concrete has been poured between the formwork panels and set, the tie rods may be removed and the resulting holes may be closed and filled to prevent leaks in the wall.

To protect the tie rods and allow for easy removal once the concrete has set, each tie rod may be enclosed inside a sleeve or tube. Conventional sleeves for tie rods are made of plastic and are cut to a desired length based on the width of the wall or other concrete structure being formed. The sleeves are then capped on either end with removable sealing cones that engage the inner surface of the formwork panels.

Human error is a common problem in measuring and cutting the sleeves to the correct length. Such errors may require the sleeves to be recut thereby slowing down production. In addition, sleeves that have been cut too short may not be useable, resulting in wasted material. Safety may also be an issue as conventional sleeves may be cut using a circular saw and shards from the plastic can penetrate the skin, eyes, and/or clothing of the user. Cutting plastic can also be hazardous in cold environments in which the plastic becomes brittle and may shatter.

SUMMARY

In one aspect, there is provided a sleeve assembly comprising: an inner tubular member comprising a first locking component; at least one outer sleeve that telescopically engages the inner tubular member in a non-expanded position and at least one expanded position, the at least one outer sleeve comprising a second locking component that interlocks with the first locking component; and wherein the first and second locking components interlock to secure the at least one outer sleeve in at least one of the non-expanded position and the at least one expanded position.

In some embodiments, one of the first and second locking components comprises a projection and the other one of the first and second locking components comprises a recess, the projection being received into the recess.

In some embodiments, the first locking component comprises the projection and the second locking component comprises the recess.

In some embodiments, the first locking component comprises the recess and the second locking component comprises the projection.

In some embodiments, the recess comprises at least one niche, the projection being received into the at least one niche to interlock the first and second locking components.

In some embodiments, the recess further comprises at least one longitudinal channel interconnected with the at least one niche, and wherein longitudinal movement of the at least one outer sleeve with respect to the inner tubular member slides the projection through the at least one longitudinal channel.

In some embodiments, the at least one longitudinal channel is rotationally offset from the at least one niche such that rotation of the at least one outer sleeve with respect to the inner tubular member displaces the projection between the at least one niche and the at least one longitudinal channel.

In some embodiments, the at least one niche comprises a first niche and a second niche.

In some embodiments, the first niche and the second niche are interconnected by a first longitudinal channel of the at least one longitudinal channel.

In some embodiments, the at least one niche comprises a first niche and a second niche.

In some embodiments, the first niche and the second niche are interconnected by a first longitudinal channel of the at least one longitudinal channel In some embodiments, the at least one niche further comprises a third niche.

In some embodiments, the second and third niche are interconnected by a second longitudinal channel of the at least one longitudinal channel.

In some embodiments, the first longitudinal channel is rotationally offset from the second longitudinal channel.

In some embodiments, the inner tubular member is longitudinally reversible with respect to the at least one outer sleeve.

In some embodiments, the at least one outer sleeve comprises a first outer sleeve and a second outer sleeve, the first and second outer sleeves positioned at opposed ends of the inner tubular member.

In some embodiments, the sleeve assembly further comprises at least one sealing member that engages at least one of the inner tubular member and the at least one outer sleeve.

In some embodiments, the at least one outer sleeve comprises an inner collar portion to sealingly engage the at least one sealing member.

In another aspect, there is provided a method for making a sleeve assembly, the method comprising: providing an inner tubular member comprising a first locking component; and providing at least one outer sleeve that telescopically engages the inner tubular member in a non-expanded position and at least one expanded position, the at least one outer sleeve comprising a second locking component that interlocks with the first locking component.

In some embodiments, providing the inner tubular member comprises integrally forming the first locking component in an outer wall thereof.

In some embodiments, providing the at least one outer sleeve comprises integrally forming the second locking component in an inner wall thereof.

In some embodiments, the method further comprises engaging the at least one outer sleeve with the inner tubular member in one of the non-expanded position and the at least one expanded position such that the first and second locking components interlock.

Other aspects and features of the present disclosure will become apparent, to those ordinarily skilled in the art, upon review of the following description of the specific embodiments of the disclosure.

BRIEF DESCRIPTION OF THE DRAWINGS

Some aspects of the disclosure will now be described in greater detail with reference to the accompanying drawings. In the drawings.

DETAILED DESCRIPTION OF EMBODIMENTS

Figure 1A:
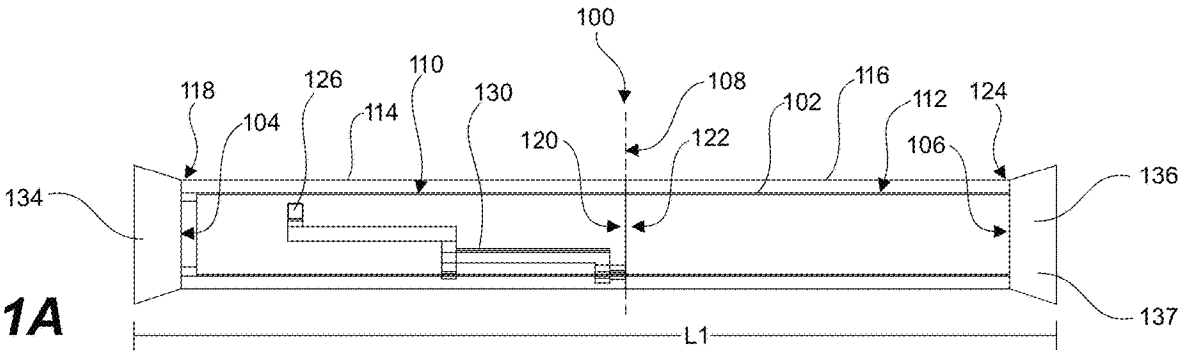
FIG. 1A is a perspective view of an example sleeve assembly according to some embodiments, showing a first outer sleeve in a non-expanded position.

Generally, the present disclosure provides a sleeve assembly. In some embodiments, the sleeve assembly is expandable into two or more lengths. The sleeve assembly may comprise an inner tubular member and at least one outer sleeve that telescopically engages the inner tubular member in a non-expanded position and at least one expanded position. In some embodiments, the inner tubular member comprises a first locking component and the at least one outer sleeve comprises a second locking component that interlocks with the first locking component to secure the at least one outer sleeve in the non-expanded position and/or at least one expanded position. Related methods for making a sleeve assembly are also provided.

It is to be understood that directional or relative terms such as "up", "down", "upward", "downward", "forward", "front", "rearward", "back", "vertical", "horizontal", "side", "top", "bottom" and the like are used for ease of description and illustrative purposes, and embodiments are not limited to a particular orientation of the sleeve assemblies described herein during use or normal operation. It will also be understood that the terms "axially" and "longitudinally" may both be used to refer to the direction of the longitudinal axis of the sleeve assemblies described herein.

As used herein and in the appended claims, the singular forms "a", "an", and "the" include plural referents unless the context clearly dictates otherwise.

An example sleeve assembly 100 will be described with reference to FIGS. 1A to 1C. The sleeve assembly 100 in this embodiment is configured to receive a rod therethrough (not shown). In some embodiments, the rod is a tie rod used to secure opposed formwork panels in a concrete wall form. In other embodiment, the rod may be any suitable rod used in the construction industry or any other suitable application. In other embodiments, the sleeve assembly 100 may be configured to provide a hollow conduit through a solid structure, such as a concrete wall, to receive any other suitable building components, for example, pipes, electrical wires, etc. It will be understood that the sleeve assembly 100 can receive any suitable structure therethrough and embodiments are not limited to the specific components and structures described herein.

The sleeve assembly 100 may comprise an inner tubular member 102 and at least one outer sleeve. The outer sleeve (s) may receive at least a portion of the inner tubular member 102 therein. In this embodiment, the sleeve assembly 100 comprises a first outer sleeve 114 and a second outer sleeve 116. In FIGS. 1A to 1C, the first and second outer sleeves 114 and 116 are shown as transparent to better show the inner tubular member 102; however, the first and second outer sleeves 114, 116 may be made of any suitable material and may be opaque in some embodiments.

In this embodiment, the inner tubular member 102 is approximately cylindrical in shape. In other embodiments, the inner tubular member 102 may be any other suitable shape. The inner tubular member 102 may have a first end 104 and an opposed second end 106. The inner tubular member 102 may have a center line 108 equidistant between the first end 104 and the second end 106. A first portion 110 of the inner tubular member 102 may extend from the first end 104 to the center line 108. A second portion 112 of the inner tubular member 102 may extend from the center line 108 to the second end 106.

The first outer sleeve 114 may at least partially receive the first portion 110 of the inner tubular member 102 therein. The second outer sleeve 116 may at least partially receive the second portion 112 of the inner tubular member 102 therein. In this embodiment, the first and second outer sleeves 114, 116 are each approximately cylindrical in shape. In other embodiments, the first and second outer sleeves 114, 116 may each be any other shape suitable to receive the inner tubular member 102 therein. FIG. 1A shows the first and second portions 110 and 112 of the inner tubular member 102 fully received into the first and second outer sleeves 114 and 116, respectively. In this embodiment, the first and second outer sleeves 114 and 116 are approximately equal in length. In other embodiments, the first and second outer sleeves 114 and 116 may be different lengths.

In this embodiment, the first outer sleeve 114 is approximately the same length as the first portion 110 of the inner tubular member 102. The first outer sleeve 114 may have a first end 118 and an opposed second end 120. When the first portion 110 of the inner tubular member 102 is fully received into the first outer sleeve 114, the first end 118 of the first outer sleeve 114 may be approximately aligned with the first end 104 of the inner tubular member 102 and the second end 120 may be approximately aligned with the center line 108. In other embodiments, the first outer sleeve 114 may be longer or shorter than the first portion 110 of the inner tubular member 102.

The second outer sleeve 116 in this embodiment is approximately the same length as the second portion 112 of the inner tubular member 102. The second outer sleeve 116 may have a first end 122 and an opposed second end 124. When the second portion 112 of the inner tubular member 102 is fully received into the second outer sleeve 116, the first end 122 may be approximately aligned with the center line 108 and the second end 124 may be approximately aligned with the second end 106 of the inner tubular member 102. In other embodiments, the second outer sleeve 116 may be longer or shorter than the second portion 112 of the inner tubular member 102.

In this embodiment, the second end 120 of the first outer sleeve 114 abuts the first end 122 of the second outer sleeve 116, approximately at the center line 108, when the first and second portions 110 and 112 of the inner tubular member 102 are fully received into the first and second outer sleeves 114 and 116, respectively. In other embodiments, there may be a gap (not shown) between the second end 120 of the first outer sleeve 114 and the first end 122 of the second outer sleeve 116, for example, in embodiments in which the first and second outer sleeves 114, 116 are different lengths.

Optionally, the sleeve assembly 100 may further comprise at least one sealing member. In this embodiment, the first end 118 of the first outer sleeve 114 and the first end 104 of the inner tubular member 102 may engage a first sealing member 134. The second end 124 of the second outer sleeve 116 and the second end 106 of the inner tubular member 102 may engage a second sealing member 136. The sealing members 134 and 136 will be discussed in more detail below with respect to FIG. 6.

At least one of the first and second outer sleeves 114 and 116 may telescopically engage the inner tubular member 102. As used herein, "telescopically engage" means that the outer sleeve and the inner tubular member 102 are able to slide axially (i.e. longitudinally) relative to one another while the inner tubular member 102 is at least partially received in the outer sleeve. At least one of the first and second outer sleeves 114 and 116 may also be rotatable with respect to the inner tubular member 102. In this embodiment, the first outer sleeve 114 telescopically engages the inner tubular member 102 and is rotatable with respect to the inner tubular member 102.

In this embodiment, the second outer sleeve 116 is secured to the inner tubular member 102 such that the second outer sleeve 116 is immobile with respect to the inner tubular member 102. In some embodiments, the second outer sleeve 116 is integral with the second portion 112 of the inner tubular member 102. In other embodiments, the second outer sleeve 116 is adhered to the inner tubular member 102 by a suitable adhesive. In other embodiments, the second outer sleeve 116 is coupled to the inner tubular member 102 using any suitable coupling means.

The sleeve assembly 100 may be longitudinally expandable to increase the overall length of the sleeve assembly 100. To expand the sleeve assembly 100, the first outer sleeve 114 may longitudinally telescope with the inner tubular member 102 to move between a non-expanded position and at least one expanded position. The term "non-expanded position" in this context refers to a position in which the inner tubular member 102 is received into the first outer sleeve 114 to its maximum extent. When the first outer sleeve 114 is in the non-expanded position, the sleeve assembly 100 is at its minimum length. The term "expanded position" in this context refers to a position in which the first outer sleeve 114 is longitudinally displaced with respect to the inner tubular member 102 such that the overall length of the sleeve assembly 100 is longer than its minimum length.

FIG. 1A shows the sleeve assembly 100 with the first outer sleeve 114 in the non-expanded position. In this example, in the non-expanded position, the first portion 110 of the inner tubular member 102 is fully received into the first outer sleeve 114. When the first outer sleeve 114 is in the non-expanded position, the sleeve assembly 100 may have a length L1 between the first sealing member 134 and the second sealing member 136. The length L1 is the minimum length of the sleeve assembly 100.

Figure 1B:
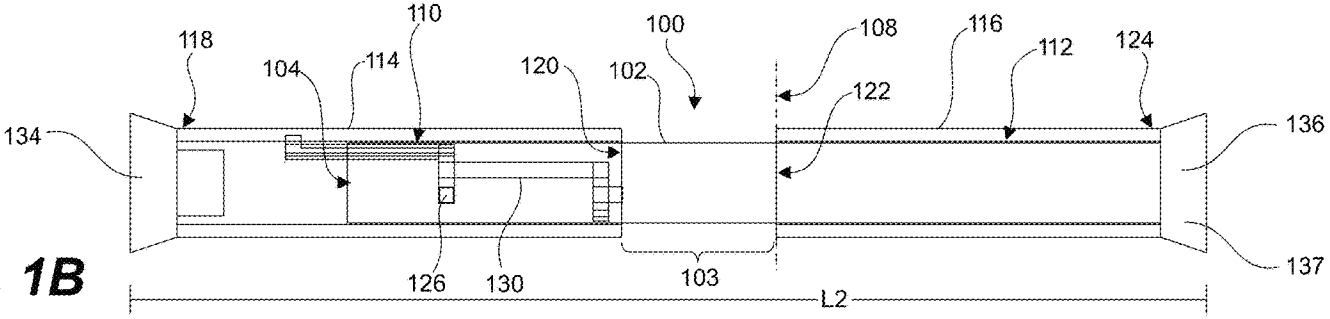
FIG. 1B is a perspective view of the sleeve assembly of FIG. 1A, showing the first outer sleeve in a first expanded position.

FIG. 1B shows the sleeve assembly 100 with the first outer sleeve 114 in a first expanded position in which the first outer sleeve 114 is longitudinally displaced with respect to the inner tubular member 102. In this position, the first portion 110 of the inner tubular member 102 is only partially received into the first outer sleeve 114, creating an exposed section 103 of the inner tubular member 102 between the second end 120 of the first outer sleeve 114 and the first end 122 of the second outer sleeve 116. When the first outer sleeve 114 is in the first expanded position, the sleeve assembly 100 may have a length L2 between the first sealing member 134 and the second sealing member 136. The length L2 may be longer than the length L1 by the length of the exposed section 103.

Figure 1C:
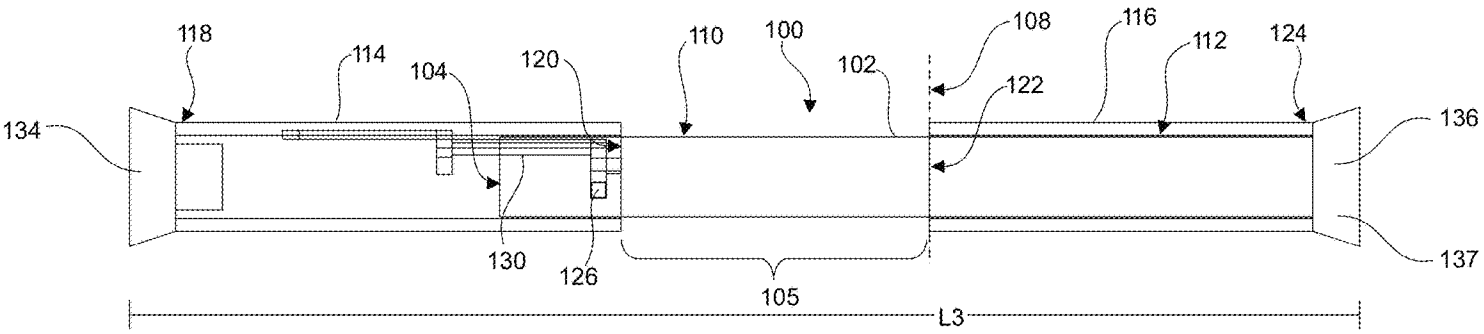
FIG. 1C is a perspective view of the sleeve assembly of FIG. 1A, showing the first outer sleeve in a second expanded position.

FIG. 1C shows the sleeve assembly 100 with the first outer sleeve 114 in a second expanded position in which the first outer sleeve 114 is further longitudinally displaced with respect to the inner tubular member 102 creating an exposed section 105 that is longer than the exposed section 103. When the first outer sleeve 114 is in the second expanded position, the sleeve assembly 100 may have a length L3 between the first sealing member 134 and the second sealing member 136. The length L3 may be longer than the length L1 by the length of the exposed section 105.

Therefore, in some embodiments, the sleeve assembly 100 has three distinct lengths L1, L2, L3 when the first outer sleeve 114 is in the non-expanded position, first expanded position, or second expanded position, respectively. In some embodiments, the lengths L1, L2, L3 may correspond to standard widths of concrete walls to be formed between adjacent formwork panels. For example, in this embodiment, L1 is about 300 mm, L2 is about 350 mm, and L3 is about 400 mm. In other embodiments, the lengths L1, L2, L3 can be any suitable lengths for applications in the construction industry or any other suitable applications. It will be understood that the specific lengths described herein are for example purposes only and embodiments are not limited to any specific lengths.

In some embodiments, the first outer sleeve 114 may be secured to the inner tubular member 102 in the non-expanded position and/or at least one expanded position to prevent unwanted movement of the first outer sleeve 114 with respect to the inner tubular member 102. In some embodiments, the inner tubular member 102 comprises a first locking component 126 and the first outer sleeve 114 comprises a second locking component 130 to interlock with the first locking component 126. The first and second locking components 126, 130 may interlock in at least one locking position. As used herein, "locking positon", when used in reference to the first and second locking components 126, 130, refers to a position in which the first and second locking components 126, 130 are interlocked to restrict movement of the first outer sleeve 114 with respect to the inner tubular member 102.

The first and second locking components 126, 130 will be discussed in more detail with reference to FIGS. 2A to 5E.

Figure 2A:
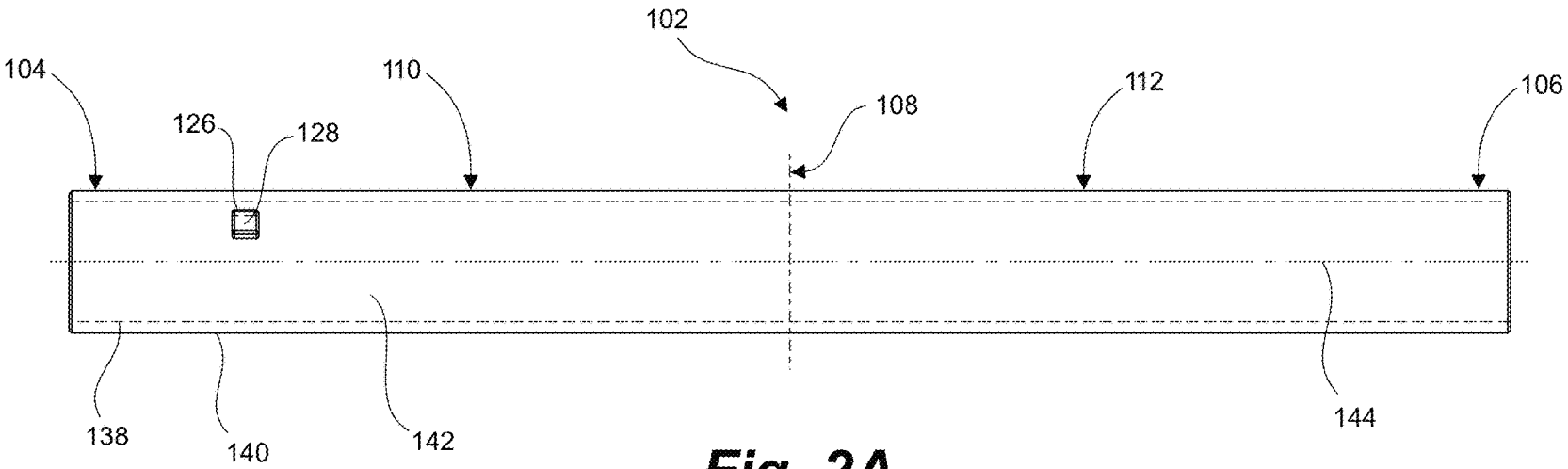
FIG. 2A is a side view of an inner tubular member of the sleeve assembly of FIGS. 1A to 1C.
Figure 2B:
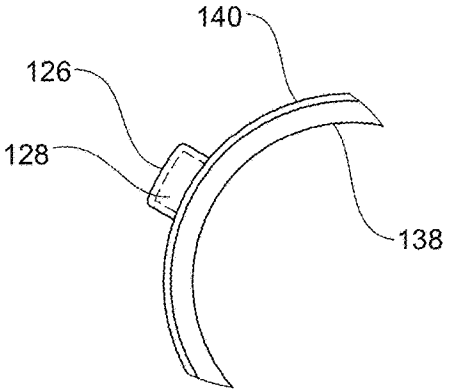
FIG. 2B is partial, end view of the inner tubular member of FIG. 2A.

FIGS. 2A and 2B show the inner tubular member 102 comprising the first locking component 126. The inner tubular member 102 may comprise an inner wall 138 and an outer wall 140. The inner wall 138 may define an internal conduit 142, extending along longitudinal axis 144, to receive at least a portion of the tie rod or another suitable component therethrough (not shown). In FIG. 2A, the inner wall 138 is shown as a stippled line as it would not normally be visible in a side view of the inner tubular member 102 but is shown for illustrative purposes to depict the internal conduit 142. In this embodiment, the internal conduit 142 has a diameter that is at least the diameter of a corresponding tie rod. In other embodiments, the internal conduit 142 may have any other diameter suitable to receive any other type of rod or any other suitable component therethrough.

The first locking component 126 in this embodiment comprises a projection 128. In some embodiments, the projection 128 is integral to the outer wall 140 of the inner tubular member 102. In other embodiments, the projection may be coupled to the outer wall 140 by any suitable coupling means. In this embodiment, the projection 128 is approximately a cube or cuboid shape. In other embodiments, the projection 128 is any other suitable shape.

The projection 128 may be disposed on the first portion 110 of the inner tubular member 102, between the first end 104 and the center line 108. In some embodiments, the projection 128 is closer towards the first end 104 of the inner tubular member 102 than the center line 108. In other embodiments, the projection 128 may be disposed at any suitable position along the first portion 110 of the inner tubular member 102.

Figure 3:
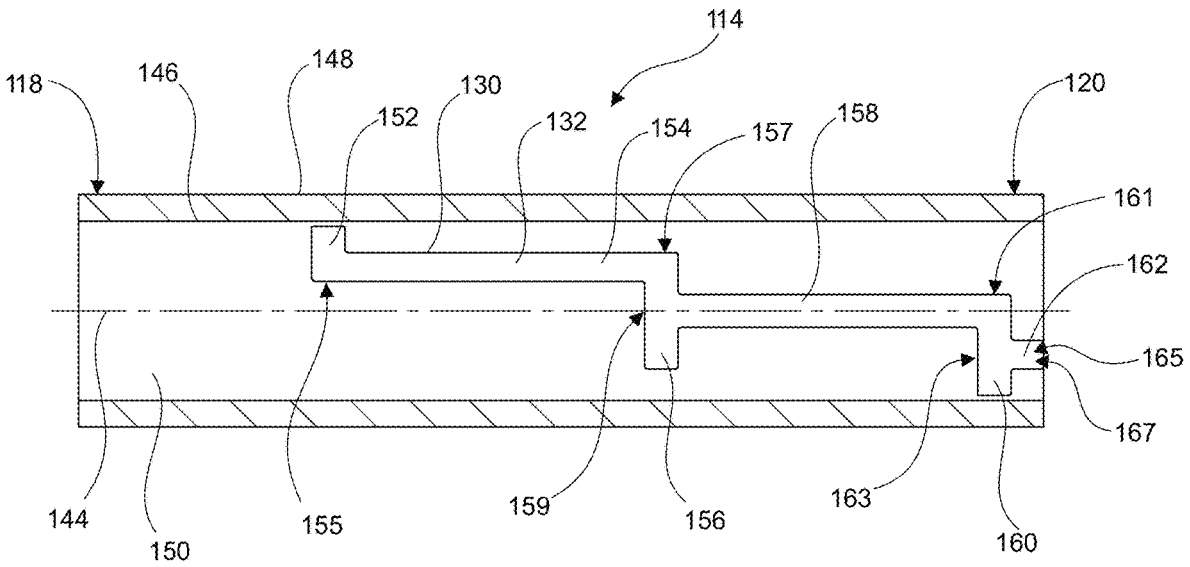
FIG. 3 is a side, cross-sectional view of a first outer sleeve of the sleeve assembly of FIGS. 1A to 1C.

FIG. 3 shows the first outer sleeve 114 comprising the second locking component 130. The first outer sleeve 114 may comprise an inner wall 146 and an outer wall 148. The inner wall 146 may define an internal conduit 150, extending along the longitudinal axis 144, to receive the first portion 110 of the inner tubular member 102 therein.

The second locking component in this embodiment comprises a recess 132 to receive the projection 128 of the first locking component 126. In some embodiments, the recess 132 is integral to the inner wall 146 of the first outer sleeve 114. The recess 132 may extend from the second end 120 of the first outer sleeve 114 towards the first end 118. The second end 120 of the first outer sleeve 114 may define an opening 167 to the recess 132 to allow the projection 128 to be received into the recess 132 when the inner tubular member 102 is received into the first outer sleeve 114.

The recess 132 may comprise at least one niche interconnected with at least one longitudinal channel. In some embodiments, each longitudinal channel is rotationally offset from at least one interconnected niche. In some embodiments, each longitudinal channel is also rotationally offset from an adjacent longitudinal channel. In some embodiments, each longitudinal channel is rotationally offset from at least one interconnected niche in one rotational direction and rotationally offset from an adjacent longitudinal channel in the opposite rotational direction.

In this embodiment, the recess 132 comprise a first niche 152 rotationally offset from a first longitudinal channel 154; a second niche 156 rotationally offset from a second longitudinal channel 158, and a third niche 160 rotationally offset from a third longitudinal channel 162. Similarly, the first longitudinal channel 154 may be rotationally offset from the second longitudinal channel 158 and the second longitudinal channel may be rotationally offset from the third longitudinal channel 162.

Figure 5A:
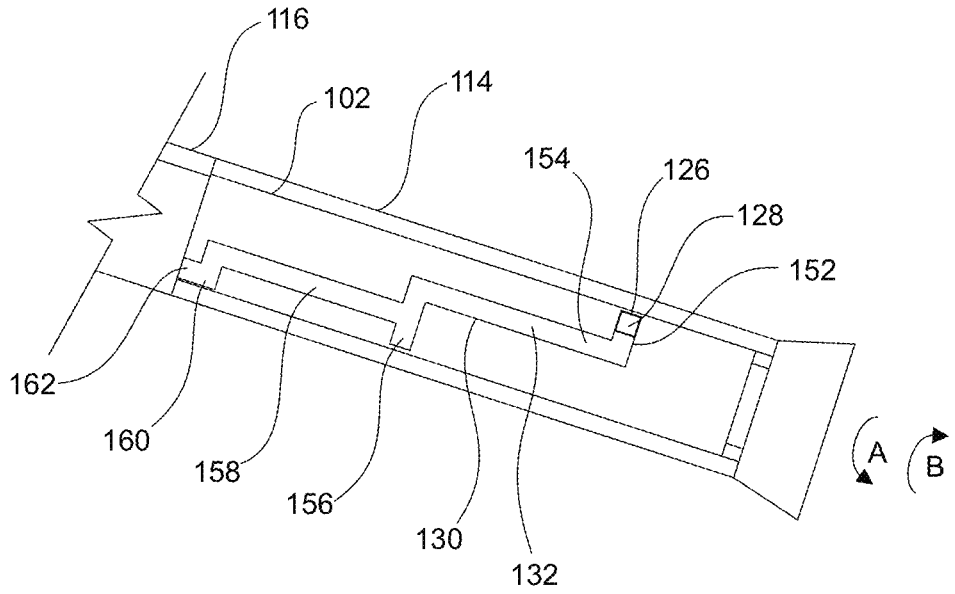
FIGS. 5A to 5E are partial, perspective views of the sleeve assembly of FIGS. 1A to 1C, showing a first locking component at various positions with respect to a second locking component.

The first niche 152 may snugly receive the projection 128 therein as shown in FIG. 5A. When the projection 128 is received in the first niche 152, the first and second locking components 126, 130 are interlocked in a first locking position and longitudinal movement of the first outer sleeve 114 with respect to the inner tubular member 102 is inhibited. In this position, rotational movement of the first outer sleeve 114 with respect to the inner tubular member 102 as indicated by arrow A is also inhibited. Therefore, in this embodiment, when the first and second locking components 126, 130 are interlocked in the first locking position, the first outer sleeve 114 is secured in the non-expanded position.

The first longitudinal channel 154 may interconnect the first niche 152 with the second niche 156. The first longitudinal channel 154 may have a first end 155 and an opposed second end 157. The first end 155 may be interconnected with the first niche 152 and the second end 157 may be interconnected with the second niche 156. The projection 128 may be displaced from the first niche 152 into the first end 155 of the first longitudinal channel 154 by rotating the first outer sleeve 114 with respect to the inner tubular member 102 as indicated by arrow B in FIG. 5A.

Figure 5B:
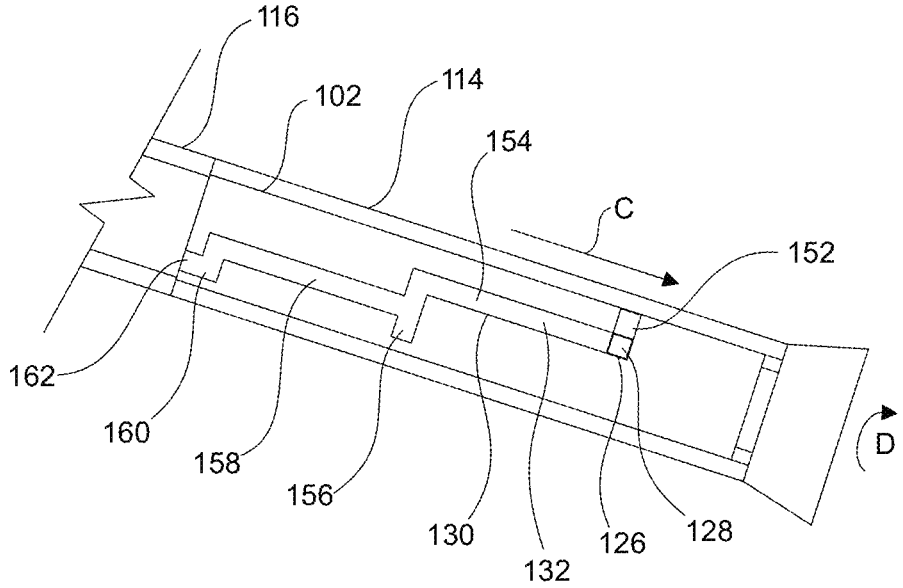

The projection 128 may then be slid through the first longitudinal channel 154 by sliding the first outer sleeve 114 longitudinally with respect to the inner tubular member 102 as indicated by arrow C in FIG. 5B. The projection 128 may be slid from the first end 155 to the second end 157 of the first longitudinal channel 154. The projection 128 may then be displaced from the second end 157 of the first longitudinal channel 154 into the second niche 156 by rotating the first outer sleeve 114 with respect to the inner tubular member 102 as indicated by arrow D in FIG. 5B.

Figure 5C:
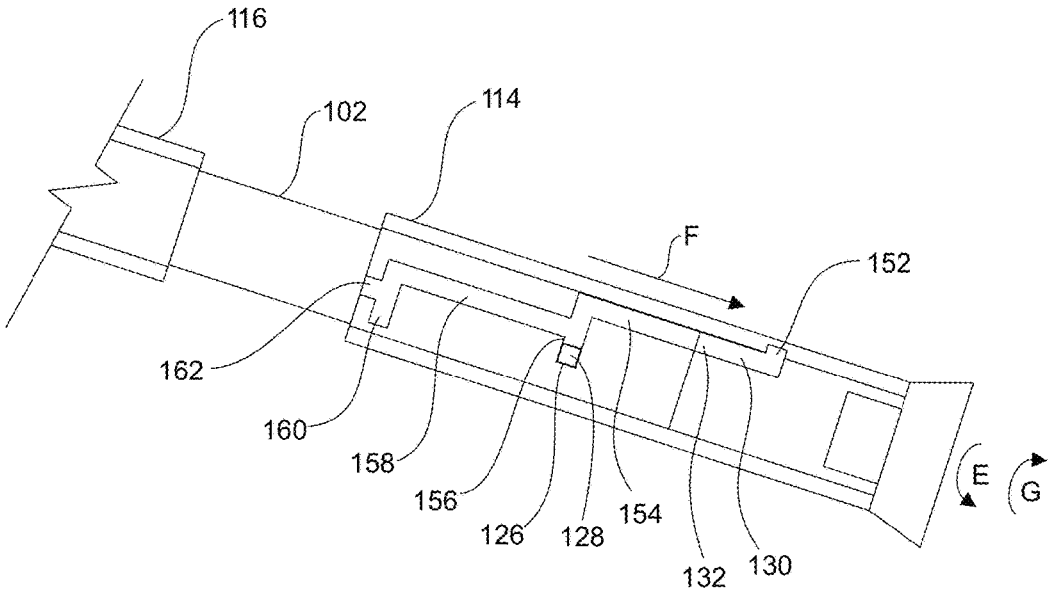

The second niche 156 may snugly receive the projection 128 therein as shown in FIG. 5C. When the projection 128 is received in the second niche 156, the first and second locking components 126, 130 are interlocked in a second locking position and longitudinal movement of the first outer sleeve 114 with respect to the inner tubular member 102 is inhibited. In this position, further rotational movement of the first outer sleeve 114 as indicated by arrow D in FIG. 5B is also inhibited. Therefore, in this embodiment, when the first and second locking components 126, 130 are interlocked in the second locking position, the first outer sleeve 114 is secured in the first expanded position.

The second longitudinal channel 158 may interconnect the second niche 156 with the third niche 160. The second longitudinal channel 158 may have a first end 159 and an opposed second end 161. The first end 159 may be interconnected with the second niche 156 and the second end 161 may be interconnected with the third niche 160. The projection 128 may be displaced from the second niche 156 into the first end 159 of the second longitudinal channel 158 by rotating the first outer sleeve 114 with respect to the inner tubular member 102 as indicated by arrow E in FIG. 5C.

The projection 128 may then be slid through the second longitudinal channel 158 by sliding the first outer sleeve 114 longitudinally with respect to the inner tubular member 102 as indicated by arrow F in FIG. 5C. The projection 128 may be slid from the first end 159 to the second end 161 of the second longitudinal channel 158. The projection 128 may then be displaced from the second end 161 of the second longitudinal channel 158 into the third niche 160 by rotating the first outer sleeve 114 with respect to the inner tubular member 102 as indicated by arrow G in FIG. 5C.

Figure 5D:
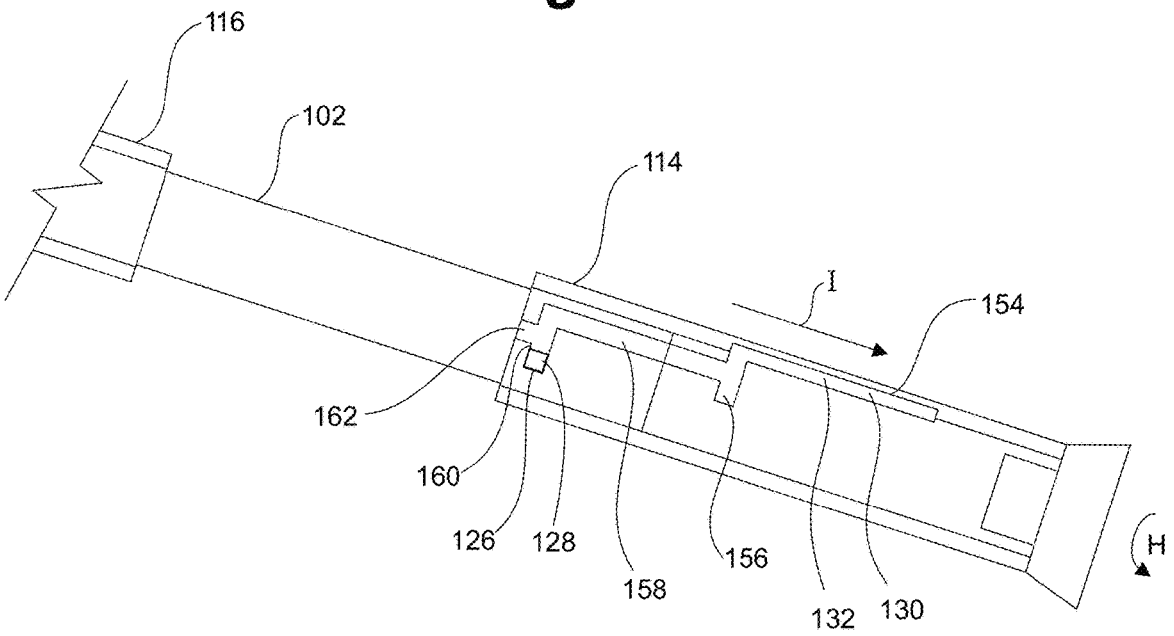
Figure 5E:
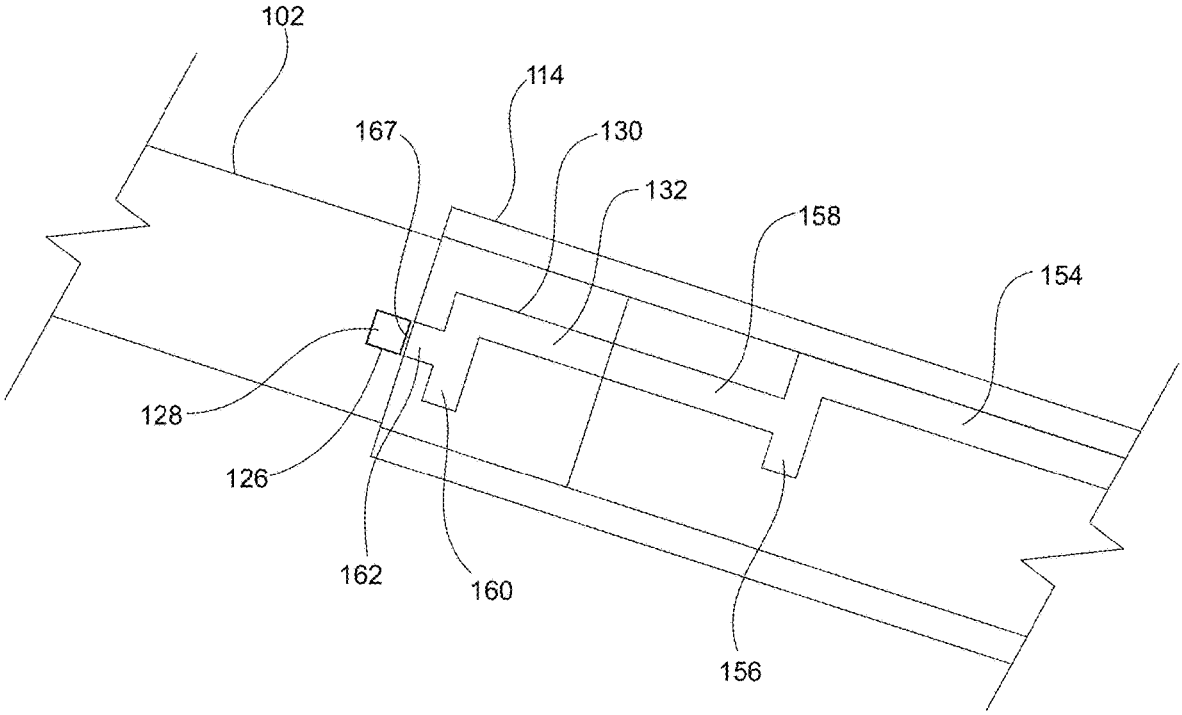

The third niche 160 may snugly receive the projection 128 therein as shown in FIG. 5D. When the projection 128 is received in the third niche 160, the first and second locking components 126, 130 are interlocked in a third locking position and longitudinal movement of the first outer sleeve 114 with respect to the inner tubular member 102 is inhibited. In this position, further rotational movement of the first outer sleeve 114 as indicated by arrow G in FIG. 5C is also inhibited. Therefore, in this embodiment, when the first and second locking components 126, 130 are interlocked in the third locking position, the first outer sleeve 114 is secured in the second expanded position.

The third longitudinal channel 162 may interconnect the third niche 160 with the opening 167 to the recess 132. The third longitudinal channel 162 may thereby function as an entry/exit channel for the recess 132. In some embodiments, the third longitudinal channel 162 may be shorter than the first and second longitudinal channels 154, 158. The third longitudinal channel 162 may have a first end 163 and an opposed second end 165. The first end 163 may be connected to the third niche 160 and the second end 165 may be connected to the opening 167 to the recess 132 at the second end 120 of the first outer sleeve 114. The projection 128 may be displaced from the third niche 160 into the first end 163 of the third longitudinal channel 162 by rotating the first outer sleeve 114 with respect to the inner tubular member 102 as indicated by arrow H in FIG. 5D.

The projection 128 may then be slid through the third longitudinal channel 162 by sliding the first outer sleeve 114 longitudinally with respect to the inner tubular member 102 as indicated by arrow I in FIG. 5D. The projection 128 may be slid from the first end 163 to the second end 165 of the third longitudinal channel 162 and out of the opening 167 to the recess 132. When the projection 128 is slid out of the opening 167, the inner tubular member 102 may be disengaged from the first outer sleeve 114.

In some embodiments, the reverse actions to those shown in FIGS. 5A to 5E may be used to assemble the inner tubular member 102 with the first outer sleeve 114 and move the first outer sleeve 114 from the third locking position to the first locking position.

A person skilled in the art will recognize that although FIGS. 5A to 5E show the first outer sleeve 114 being moved as indicated by arrows A to I while the inner tubular member 102 is stationary, the same effect may be achieved by moving the inner tubular member 102 in the opposite direction to arrows A to I while the first outer sleeve 114 is stationary.

Therefore, when the first outer sleeve 114 telescopes from the non-expanded position to the first expanded position, the length of the sleeve assembly 100 may thereby increase from L1 to L2 by the length of the first longitudinal channel 154. In this embodiment, the length of the first longitudinal channel 154 is approximately 50 mm. When the first outer sleeve 114 telescopes from the first expanded position to the second expanded position, the length of the sleeve assembly 100 thereby increases from L2 to L3 by the length of the second longitudinal channel 158. In this embodiment, the length of the second longitudinal channel 158 is approximately 50 mm.

In other embodiments, the first and second longitudinal channels 154, 158 may be any other suitable lengths to increase the lengths L2 and L3 of the sleeve assembly 100 by a desired amount. In other embodiments, additional niches, interconnected with additional longitudinal channels, may be provided to further expand the sleeve assembly 100 to increased lengths.

In other embodiments, the first locking component 126 may comprise a recess and the second locking component 130 may comprise a projection. In other embodiments, the first and second locking components 126,130 may comprise any other suitable complementary locking components and embodiments are not limited to projections and recesses.

Figure 4:
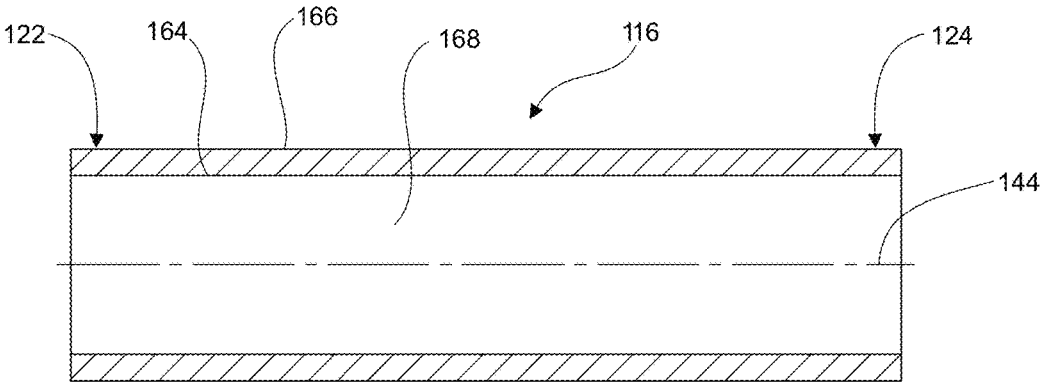
FIG. 4 is a side, cross-sectional view of a second outer sleeve of the sleeve assembly of FIGS. 1A to 1C.

Referring now to FIG. 4, the second outer sleeve 116 may comprise an inner wall 164 and an outer wall 166. The inner wall 164 may define an internal conduit 168, extending along the longitudinal axis 144, to receive the second portion 112 of the inner tubular member 102 therein. In this embodiment, the second outer sleeve 116 securely engages the second portion 112, as discussed with respect to FIGS. 1A to 1C above.

In other embodiments, the second portion 112 of the inner tubular member 102 may comprise a third locking component (not shown) and the second outer sleeve 116 may comprise a fourth locking component (not shown) to interlock with the third locking component. In some embodiments, the third and fourth locking components may be similar to the first and second locking components 126 and 130 as described above. In other embodiments, the sleeve assembly 100 may be provided with only the first outer sleeve 114 and not the second outer sleeve 116.

Figure 6:
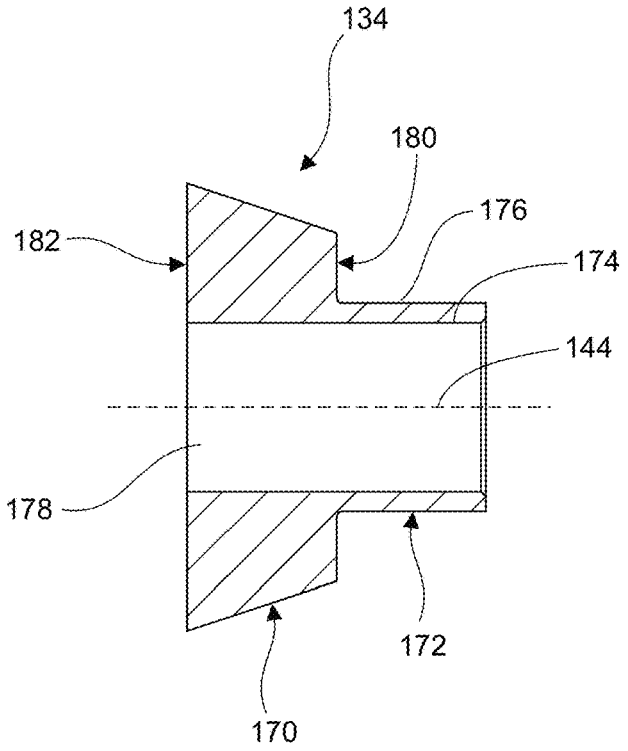
FIG. 6 is a side, cross-sectional view of a sealing member of the sleeve assembly of FIGS. 1A to 1C.

FIG. 6 shows a cross-section of the first sealing member 134. The first sealing member 134 may comprise an inner wall 174 and an outer wall 176. The inner wall 174 may define an internal conduit 178 therethrough, extending along longitudinal axis 144, to receive the tie rod or other component (not shown) therethrough.

The first sealing member 134 may comprise a plug portion 172 and a cap portion 170. In this embodiment, the plug portion 172 is approximately cylindrical in shape. In other embodiments, the plug portion 172 may be any other suitable shape. When the first outer sleeve 114 is in the non-expanded position (e.g. as shown in FIG. 1A), the plug portion 172 of the first sealing member 134 may be received into the internal conduit 142 of the inner tubular member 102. In some embodiments, the plug portion 172 may sealingly engage the inner wall 138 of the inner tubular member 102. As used herein, "sealingly engage" means to contact in a manner to restrict the passage of fluid or solid particles therethrough. However, it will be understood that the seal may not be a perfect seal.

In this embodiment, the cap portion 170 of the first sealing member 134 is approximately frustoconical in shape. In other embodiments, the cap portion 170 may be any other suitable shape. The cap portion 170 may have a first end 180 and a second end 182. When the first outer sleeve 114 is in the non-expanded position, the first end 180 of the cap portion 170 abuts the first end 118 of the first outer sleeve 114 and the first end 104 of the inner tubular member 102. The second end 182 of the cap portion 170 may abut an inner surface of a formwork panel (not shown). Therefore, in some embodiments, the first sealing member 134 may sealingly engage the sleeve assembly 100 with the inner surface of the formwork panel.

As the first outer sleeve 114 is moved from the non-expanded position to the first or second expanded position (as shown in FIGS. 1B and 1C, respectively), the first sealing member 134 may be displaced from the inner tubular member 102 while remaining engaged with the first outer sleeve 114. Therefore, in the first and second expanded positions, the plug portion 172 of the first sealing member 134 may be received into the internal conduit 150 of the first outer sleeve 114 and the cap portion 170 may abut the first end 118 of the first outer sleeve 114.

The second sealing member 136 may have a similar structure to the first sealing member 134. The second sealing member 136 may have a cap portion 137 (visible in FIGS. 1A to 1C) and a plug portion (not shown). The plug portion may be received into the internal conduit 142 of the inner tubular member 102. The cap portion 137 may abut the second end 124 of the second outer sleeve 116 and the second end 106 of the inner tubular member 102. As the second outer sleeve 116 is not movable in this embodiment, the second sealing member 136 will remain engaged with both the second outer sleeve 116 and the inner tubular member 102 even when the sleeve assembly 100 is expanded. The second sealing member 136 may thereby sealingly engage the sleeve assembly 100 with an inner surface of another formwork panel (not shown).

In other embodiments, the sleeve assembly 100 may comprise any other suitable sealing member and embodiments are not limited to the specific sealing members described herein.

Figure 7:
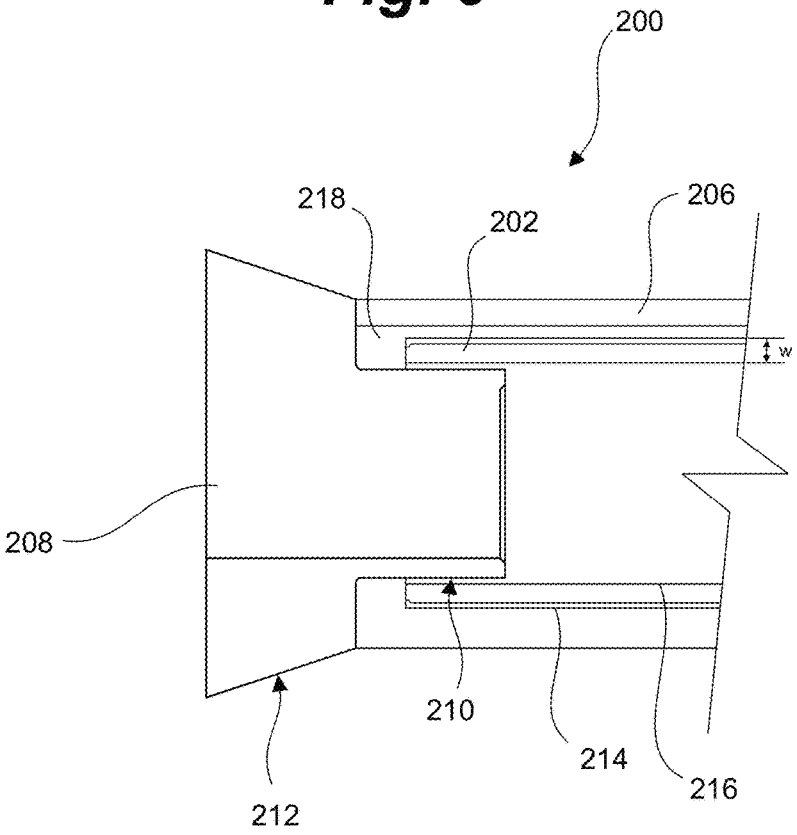
FIG. 7 is a partial, side view of another example sleeve assembly, according to some embodiments.

An alternative embodiment of a sleeve assembly 200 is shown in FIG. 7. The sleeve assembly 200 in this embodiment comprises an inner tubular member 202 and a first outer sleeve 206. The first outer sleeve 206 may telescopically engage the inner tubular member 202 in a non-expanded position (shown in FIG. 7) and at least one expanded position (not shown). Optionally, the sleeve assembly 200 further comprises a second outer sleeve (not shown).

The sleeve assembly 200 may further comprise a sealing member 208 having a plug portion 210 and a cap portion 212. The sealing member 208 may be similar in structure to the first sealing member 134 of FIG. 6 as described above.

The first outer sleeve 206 may comprise an outer wall 214 and an inner wall 216. In this embodiment, the first outer sleeve 206 further comprises an inner collar portion 218 defined by the inner wall 216. The inner collar portion 218 may have a width W that is approximately the same as the width of the inner tubular member 202. When the first outer sleeve 206 is in the non-expanded position, the inner tubular member 202 may be fully received into the first outer sleeve 206 such that inner tubular member 202 abuts the inner collar portion 218 of the first outer sleeve 206.

When the first outer sleeve 206 is in the non-expanded position, the plug portion 210 of the sealing member 208 may sealingly engage both the inner tubular member 202 and the inner collar portion 218 of the first outer sleeve 206. As the first outer sleeve 206 is expanded into at least one expanded position, the plug portion 210 may be displaced from the inner tubular member 202 but may remain in sealing engagement with the inner collar portion 218 of the first outer sleeve 206. Thus, the inner collar portion 218 may help to secure the sealing member 208 to the first outer sleeve 206 to prevent the sealing member 208 from disengaging from the first outer sleeve 206 during use. The sealing engagement between the plug portion 210 and the inner collar portion 218 may also prevent concrete and other materials from entering the first outer sleeve 206.

Another example sleeve assembly 300 will be discussed with reference to FIGS. 8A to 8G.

Figure 8A:
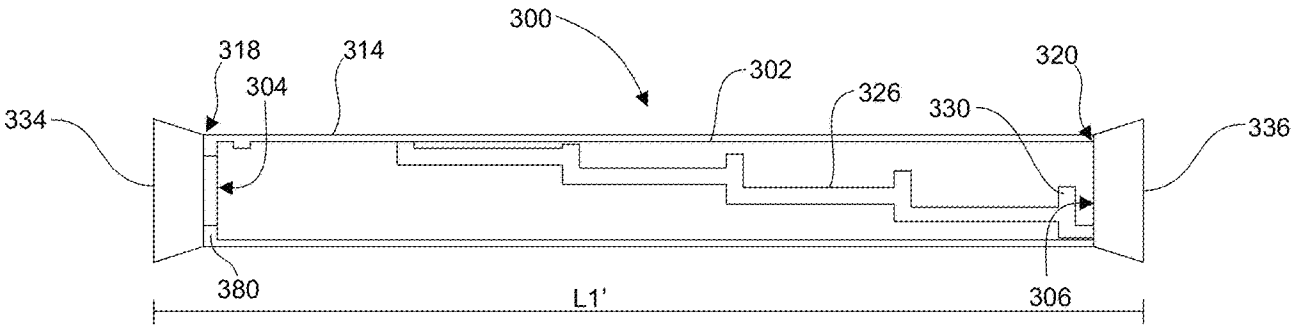
FIG. 8A is a perspective view of another example sleeve assembly according to some embodiments, showing a first outer sleeve in a non-expanded position.

The sleeve assembly 300 may comprise an inner tubular member 302 and at least one outer sleeve. In this embodiment, the sleeve assembly 300 comprises a first outer sleeve 314 and, optionally, a second outer sleeve 316 (the second outer sleeve 316 is shown in FIG. 8G only). In FIGS. 8A to 8G, the first and second outer sleeves 314 and 316 are shown as transparent to better show the inner tubular member 302; however, the first and second outer sleeves 314 and 316 may be made of any suitable material and may be opaque in some embodiments. Optionally, the sleeve assembly 300 may further comprise a first sealing member 334 and a second sealing member 336 at opposed ends thereof.

The inner tubular member 302 may have a first end 304 and an opposed second end 306. The first outer sleeve 314 may have a first end 318 and an opposed second end 320. In some embodiments, the first outer sleeve 314 is approximately the same length, or slightly longer than, the inner tubular member 302. In this embodiment, first outer sleeve 314 is slightly longer than the inner tubular member 302 to provide space for an inner collar portion 380, as discussed in more detail below. In other embodiments, the first outer sleeve 314 and the inner tubular member 302 may be any other suitable length.

The first outer sleeve 314 may at least partially receive the inner tubular member 302 therein. The first outer sleeve 314 may telescopically engage the inner tubular member 302 in a non-expanded position and at least one expanded position. FIG. 8A shows the sleeve assembly 300 with the first outer sleeve 314 in the non-expanded position. In this embodiment, when the first outer sleeve 314 is in the non-expanded position, the inner tubular member 302 is fully received into the first outer sleeve 314. In this position, the first end 304 of the inner tubular member 302 is proximate the first end 318 of the first outer sleeve 314 and the second end 306 of the inner tubular member 302 is proximate the second end 320 of the first outer sleeve 314. In the non-expanded position, the sleeve assembly 300 may have an overall length of L1', inclusive of the first and second sealing members 334 and 336. The length L1' is the minimum length of the sleeve assembly 300.

In some embodiments, the inner tubular member 302 may be longitudinally reversible such that the first outer sleeve 314 can also engage the inner tubular member 302 in the reverse orientation (not shown). When the first outer sleeve 314 is in the non-expanded position in the reverse orientation, the first end 304 of the inner tubular member 302 is proximate the second end 320 of the first outer sleeve 314 and the second end 306 of in the inner tubular member 302 is proximate the first end 318 of the first outer sleeve 314.

Figure 8B:
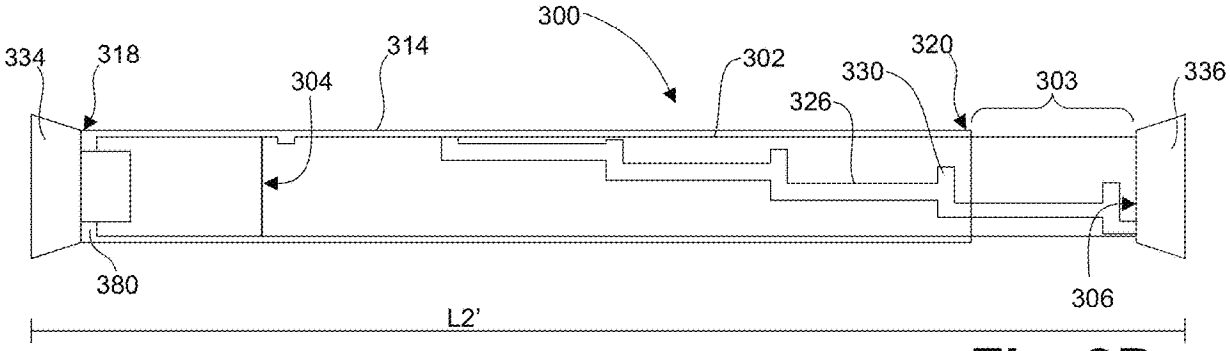
FIG. 8B is a perspective view of the sleeve assembly of FIG. 8A, showing the first outer sleeve in a first expanded position.
Figure 8C:
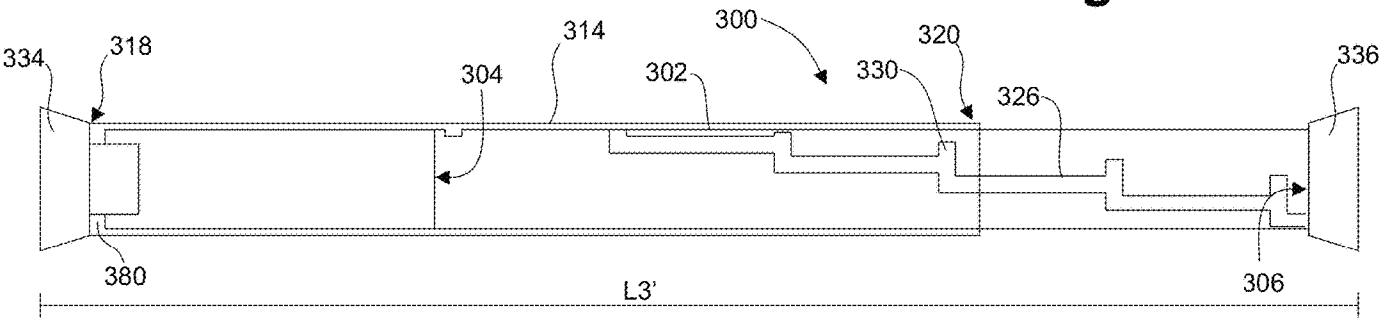
FIG. 8C is a perspective view of the sleeve assembly of FIG. 8A, showing the first outer sleeve in a second expanded position.
Figure 8D:
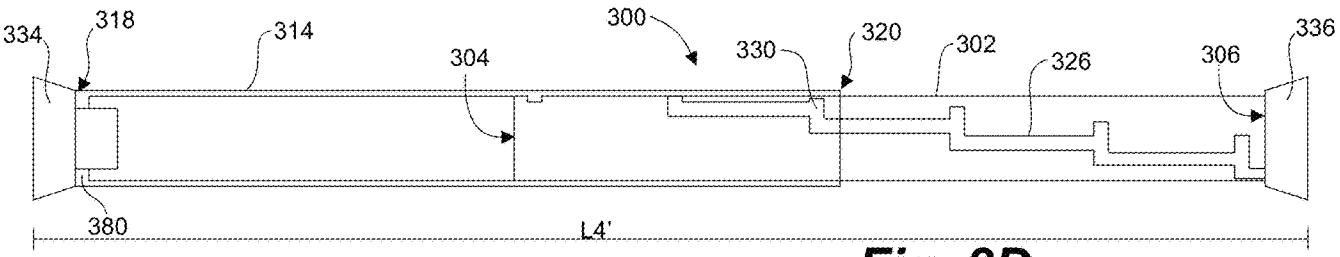
FIG. 8D is a perspective view of the sleeve assembly of FIG. 8A, showing the first outer sleeve is a third expanded position.
Figure 8E:
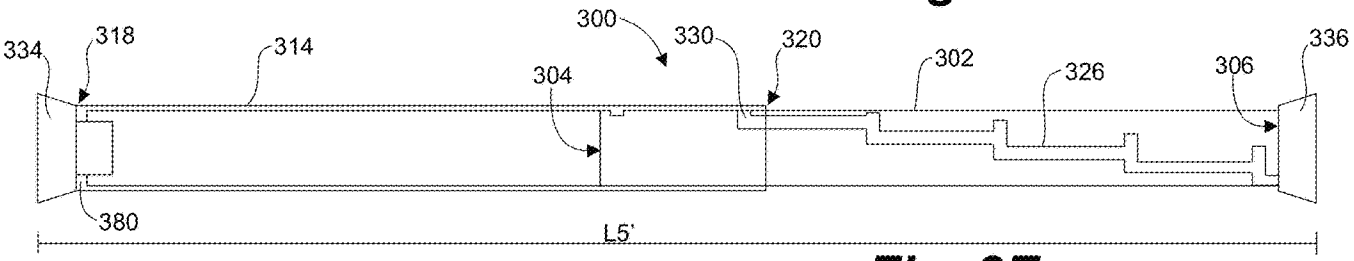
FIG. 8E is a perspective view of the sleeve assembly of FIG. 8A, showing the first outer sleeve in a fourth expanded position.
Figure 8F:
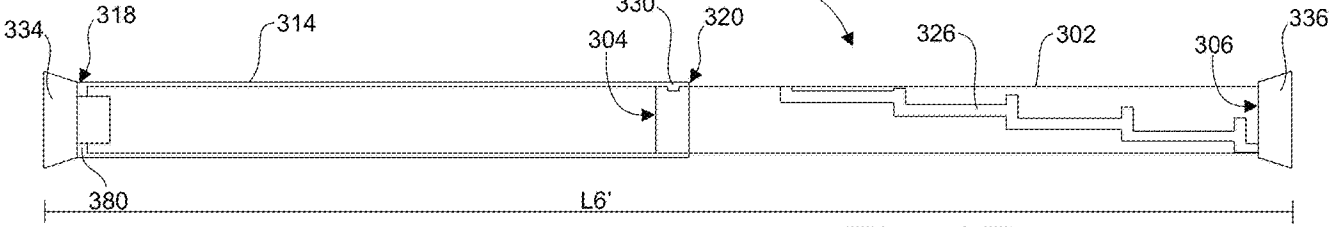
FIG. 8F is a perspective view of the sleeve assembly of FIG. 8A, showing the first outer sleeve in a fifth expanded position.
Figure 8G:
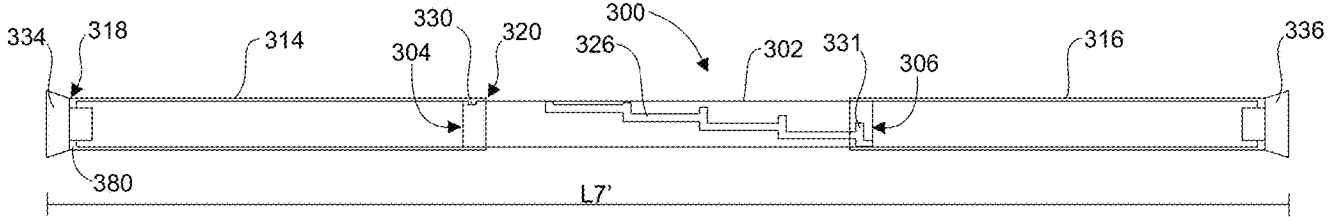
FIG. 8G is a perspective view of the sleeve assembly of FIG. 8A, showing the first outer sleeve in the fifth expanded position and including a second outer sleeve.

FIG. 8B shows the sleeve assembly 300 with the first outer sleeve 314 in a first expanded position in which the first outer sleeve 314 is longitudinally displaced with respect to the inner tubular member 302. In this position, the inner tubular member 302 is only partially received into the first outer sleeve 314, creating an exposed section 303 of the inner tubular member 302 between the second end 320 of the first outer sleeve 314 and the second end 306 of the inner tubular member 302. When the first outer sleeve 314 is in the first expanded position, the sleeve assembly 300 may have a length L2' that is longer than the length L1'.

FIGS. 8C, 8D, 8E, and 8F show the sleeve assembly 300 with the first outer sleeve 314 in a second, third, fourth, and fifth expanded position, respectively. When the first outer sleeve 314 is in the second, third, fourth, and fifth expanded position, the sleeve assembly 300 has a length of L3', L4', L5', and L6', respectively. In some embodiments, each of lengths L1' to L6' increases by approximately 50 mm. For example, in this embodiment, L1' is about 300 mm, L2' is about 350 mm, L3' is about 400 mm, L4' is about 450 mm, L5' is about 500 mm, and L6' is about 550 mm. In other embodiments, each of lengths L1' to L6' may increase by any other suitable length and lengths L1' to L6' may be any suitable lengths.

FIG. 8G shows the sleeve assembly 300 with the first outer sleeve 314 and the second outer sleeve 316 engaging the first and second ends 304 and 306 of the inner tubular member 302, respectively. In this embodiment, the second outer sleeve 316 has substantially the same structure and length as the first outer sleeve 314. In other embodiments, the second outer sleeve 316 may have a different structure and/or length than the first outer sleeve 314. In the example shown in FIG. 8G, the first outer sleeve 314 is in the fifth expanded position and the second outer sleeve 316 is in an equivalent position at the opposite end of the inner tubular member 302. In this position, the sleeve assembly 300 has an overall length of L7'. In this embodiment, the length L7' is about 805 mm. In other embodiments, the first and second outer sleeves 314 and 316 may engage the inner tubular member 302 at any other suitable positions to increase or decrease the overall length of the sleeve assembly 300 as desired.

In some embodiments, the first outer sleeve 314 may be secured to the inner tubular member 302 in the non-expanded position and/or in at least one expanded position. In some embodiments, the inner tubular member 302 comprises a first locking component 326 and the first outer sleeve 314 comprises a second locking component 330 that interlocks with the first locking component 326 when the first outer sleeve 314 is engaged with the inner tubular member 302.

Figure 9A:
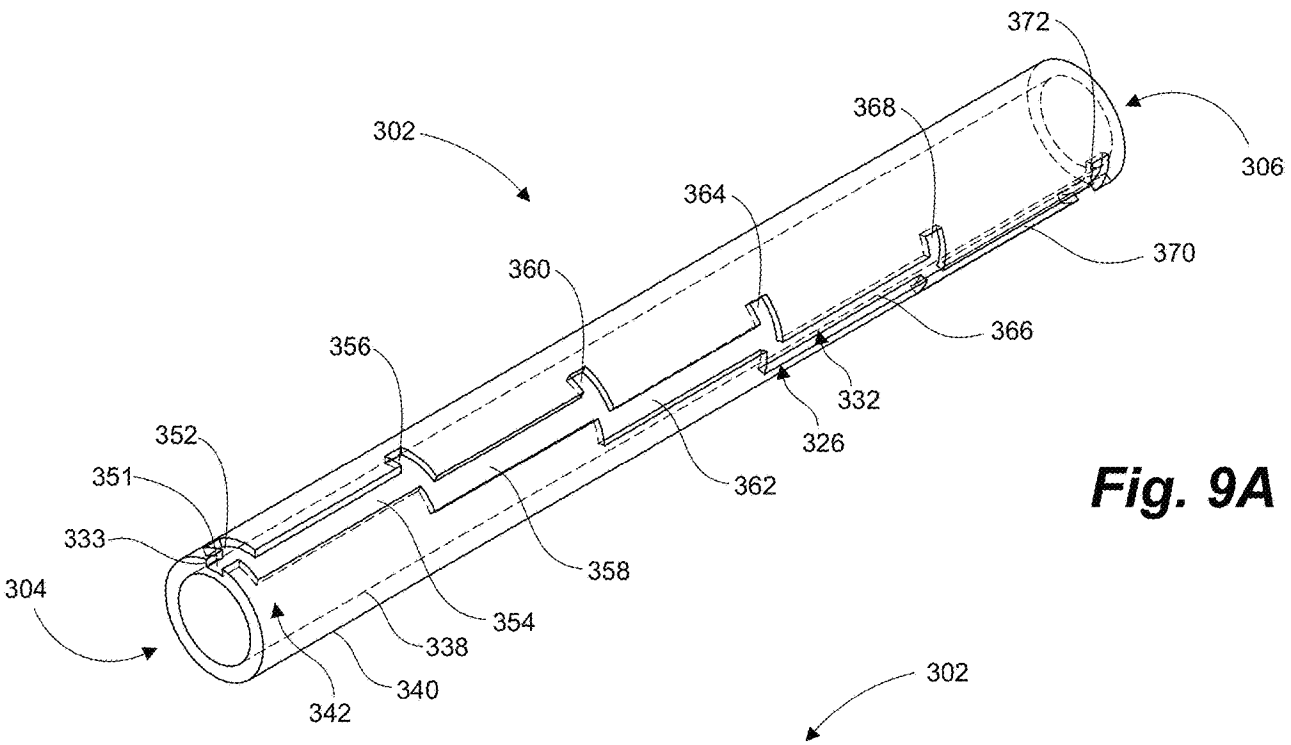
FIG. 9A is a perspective view of an inner tubular member of the sleeve assembly of FIGS. 8A to 8G.
Figure 9B:
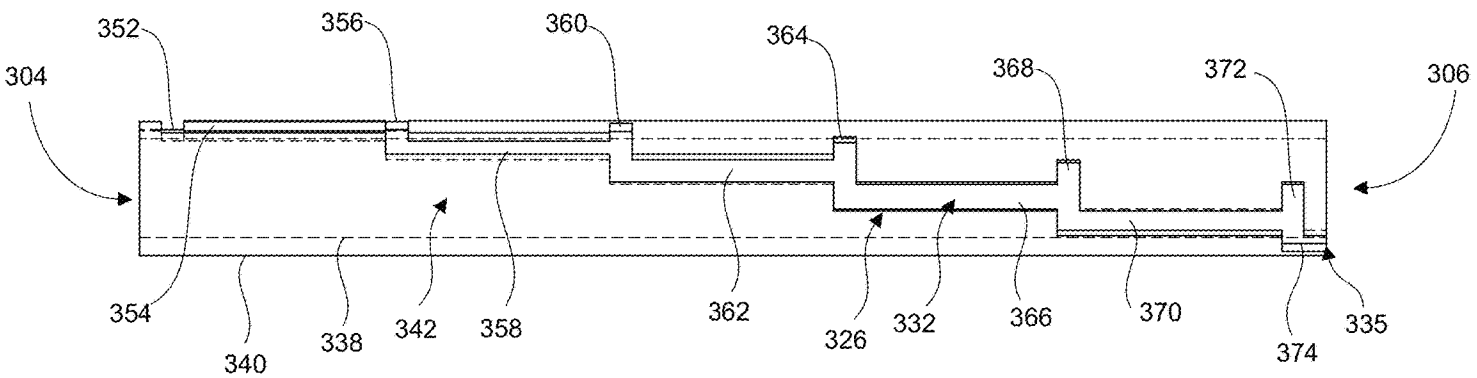
FIG. 9B is a side view of the inner tubular member of FIG. 9A.

FIGS. 9A and 9B show the inner tubular member 302 comprising the first locking component 326. The inner tubular member 302 may comprise an inner wall 338 and an outer wall 340. The inner wall 338 may define an internal conduit 342. The internal conduit 342 may be any suitable diameter to receive at least a portion of a tie rod or any other suitable component therethrough (not shown). In FIG. 9A, the inner wall 338 is shown as a stippled line as it would not normally be visible in a side, perspective view of the inner tubular member 302 but is shown for illustrative purposes to depict the internal conduit 342.

In this embodiment, the first locking component 326 comprises a recess 332 in the outer wall 340 of the inner tubular member 302. The recess 332 may extend from the first end 304 to the second end 306 of the inner tubular member 302. The recess 332 may have a first opening 333 at the first end 304 of the inner tubular member 302 and a second opening 335 at the second end 306 of the inner tubular member 302 (the first opening 333 is visible in FIG. 9A and the second opening 3356 is visible in FIG. 9B).

In this embodiment, the recess 332 comprises first, second, third, fourth, fifth, and sixth niches 352, 356, 360, 364, 368, and 372. The recess 332 also comprises first, second, third, fourth, fifth, sixth, and seventh longitudinal channels 351, 354, 358, 362, 366, 370, and 374 (the first longitudinal channel 351 is only visible in FIG. 9A and the seventh longitudinal channel 374 is only visible in FIG. 9B). The first longitudinal channel 351 may be interconnected to the first opening 333 and the seventh longitudinal channel 374 may be interconnected to the second opening 335, thereby functioning as entry/exit channels to the recess 332. In this embodiment, each of the second, third, fourth, fifth, and sixth longitudinal channels 354, 358, 362, 366, 370 may be approximately 50 mm in length to allow the sleeve assembly 300 to be expanded from the non-expanded position (L1') to the fifth expanded position (L6') in 50 mm increments as described above. In other embodiments, each longitudinal channel 354, 358, 362, 366, 370 may be any suitable length to expand the sleeve assembly 300 in any suitable increments.

Each longitudinal channel may be interconnected with at least one niche and may be rotationally offset from at least one niche and at least one adjacent longitudinal channel. As one example, the second longitudinal channel 354 interconnects the first and second niches 352 and 356, and is rotationally offset from the first and second niches 352 and 356 in one rotational direction and rotationally offset from the third longitudinal channel 358 in the opposite rotational direction.

Figure 10A:
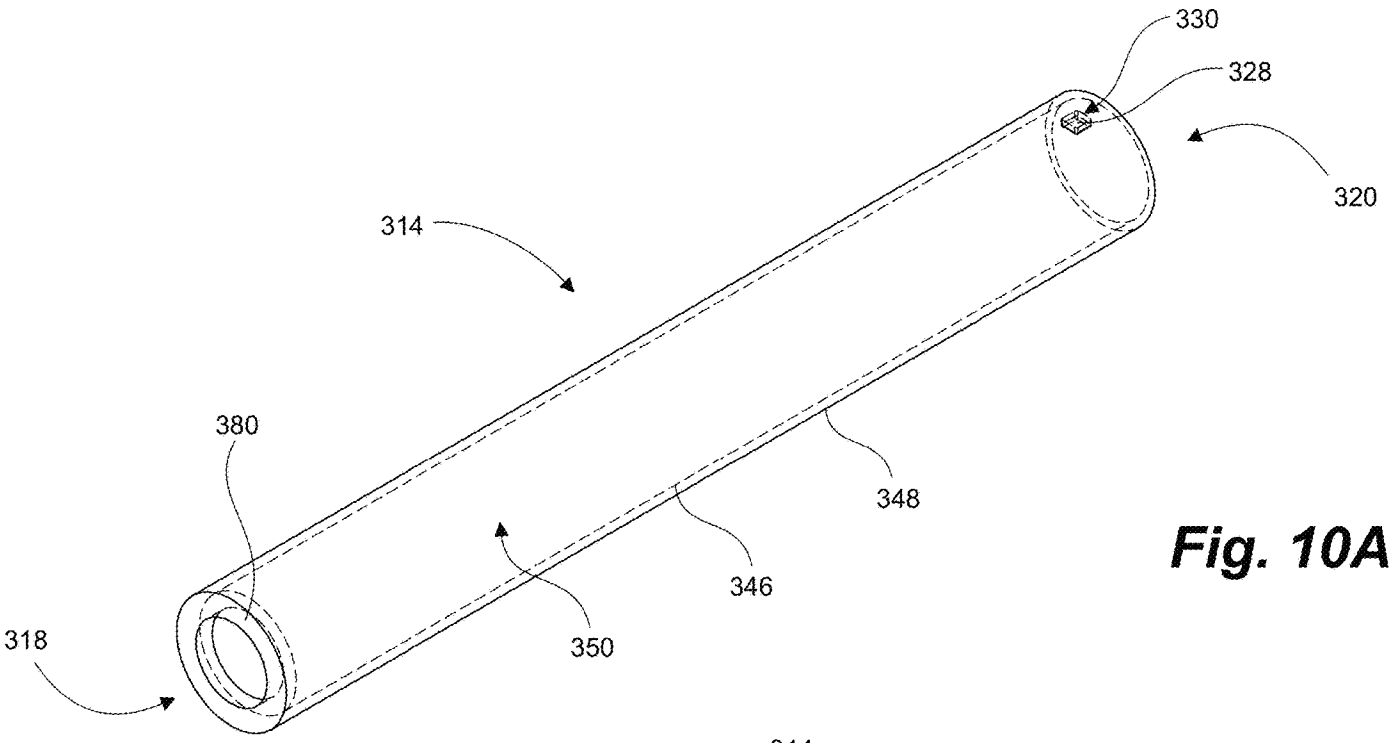
FIG. 10A is a perspective view of a first outer sleeve of the sleeve assembly of FIGS. 8A to 8G.
Figure 10B:
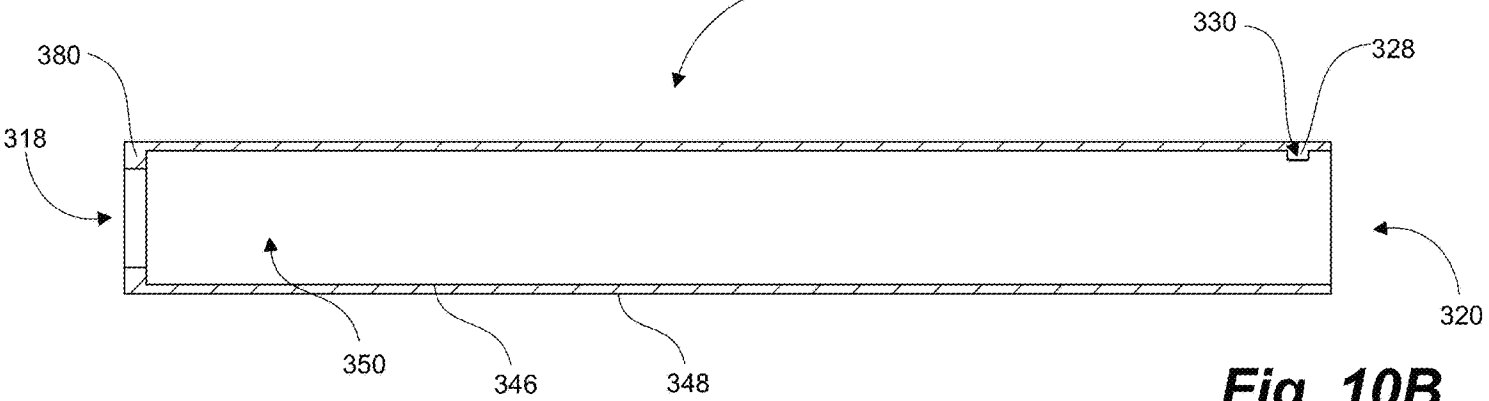
FIG. 10B is a side, cross-sectional view of the first outer sleeve of FIG. 10A.

FIGS. 10A and 10B show the first outer sleeve 314 comprising the second locking component 330. The first outer sleeve 314 may comprise an inner wall 346 and an outer wall 348. The inner wall 346 may define an internal conduit 350 to receive at least a portion of the inner tubular member 302 therein. In FIG. 10A, the inner wall 346 is shown as a stippled line as it would not normally be visible in a side, perspective view of the first outer sleeve 314 but is shown for illustrative purposes to depict the internal conduit 350.

In this embodiment, the first outer sleeve 314 comprises an inner collar portion 380 at the first end 318 of the first outer sleeve 314. The inner collar portion 380 may be similar to the inner collar portion 218 of the sleeve assembly 200 of FIG. 7 as described above. The inner collar portion 380 may allow the first outer sleeve 314 to maintain sealingly engagement with the first sealing member 334 as the first outer sleeve 314 is moved from the non-expanded position (as shown in FIG. 8A) to each of the expanded positions shown in FIGS. 8B to 8F.

In this embodiment, the second locking component 330 comprises a projection 328 extending from the inner wall 346 of the first outer sleeve 314. The projection 328 may be disposed proximate the second end 320 of the first outer sleeve 314. Alternatively, the projection 328 may be disposed at any other suitable location along the first outer sleeve 314. The projection 328 may be similar to the projection 128 of the sleeve assembly 100 as described above.

The projection 328 may be received into the recess 332 of the first locking component 326 to interlock the first and second locking components 326 and 330. The projection 328 may enter and exit the recess 332 through either the first opening 333 or the second opening 335, thereby allowing the first outer sleeve 314 to be secured to the inner tubular member 302 in either longitudinal orientation of the inner tubular member 302. In this embodiment, the projection 328 may be received into the first, second, third, fourth, fifth, and sixth niches 352, 356, 360, 364, 368, and 372 to interlock the first and second locking components 326 and 330 and thereby secure the first outer sleeve 314 in the non-expanded position and each of the expanded positions shown in FIGS. 8B to 8F as discussed above. The projection 328 may also be slid through the first, second, third, fourth, fifth, sixth, and seventh longitudinal channels 351, 354, 358, 362, 366, 370, and 374 to move between the non-expanded position and each of the expanded positions. The first outer sleeve 314 may be slid longitudinally and rotated with respect to the inner tubular member 302, as appropriate, to expand and contract the sleeve assembly 300 in a similar manner to that described above for the sleeve assembly 100.

In some embodiments, the second outer sleeve 316 may have a similar structure to the first outer sleeve 314 and may comprise a third locking component 331 (the third locking component 331 is visible in FIG. 8G). The third locking component 331 may comprise a projection (not shown) that can be received into the recess 332. The projection of the third locking component 331 may be similar to the projection 328 of the first outer sleeve 314. The first and third locking components 326 and 331 may thereby interlock to secure the second outer sleeve 316 to the inner tubular member 302 in a non-expanded position and at least one expanded position.

As shown in FIG. 8G, both the first and second outer sleeves 314 and 316 can be secured to the inner tubular member 302 in respective expanded positions at the same time. The projection 328 of the second locking component 330 may be received into the recess 332 via the first opening 333 and the projection (not shown) of the third locking component 331 may be received into the recess 332 via the second opening 335 (or vice versa). Each of the first and second outer sleeves 314 and 316 may be rotated and slid longitudinally with respect to the inner tubular member 302 to expand and contract the sleeve assembly 300 as desired.

Other variations are also possible. In some embodiments, the recess 332 may comprise additional niches and longitudinal channels to allow for additional lengths. In some embodiments, the niches and longitudinal channels may be arranged in alternative patterns while still allowing the projection 328 to be moved through the recess 332 by a combination of longitudinal and rotational movements. It will also be understood that each niche and longitudinal channel can be any suitable length, width, and depth, and embodiments are not limited to the specific dimensions disclosed herein.

Figure 11:
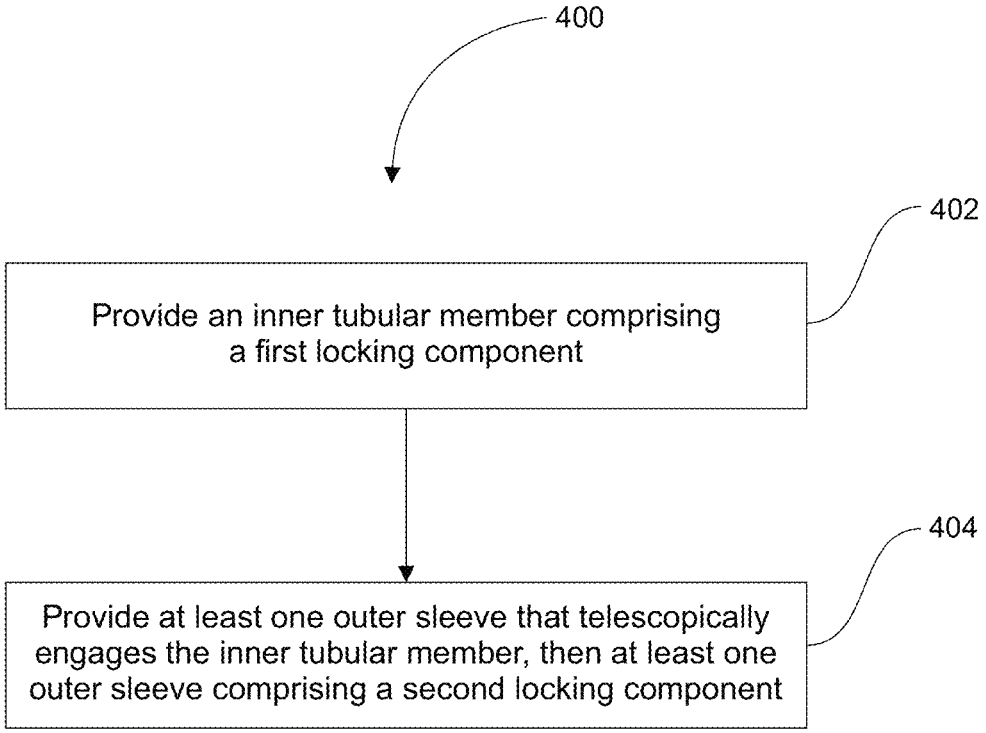
FIG. 11 is a flowchart of an example method for making a sleeve assembly, according to some embodiments.

FIG. 11 is a flowchart of an example method 400 for making a sleeve assembly, according to some embodiments. The method 400 may be used to make embodiments of the sleeve assemblies 100, 200, and 300 described herein.

At block 402, an inner tubular member is provided. At block 404, at least one outer sleeve is provided. The outer sleeve may telescopically engage the inner tubular member in a non-expanded position and at least one expanded position. The inner tubular member may comprise a first locking component and the outer sleeve may comprise a second locking component that interlocks with the first locking component when the outer sleeve engages the inner tubular member. The term "providing" in this context may refer to making, manufacturing, receiving, or otherwise obtaining the inner tubular member and at least one outer sleeve. In some embodiments, the inner tubular member may be provided in the same manner as the outer sleeve. In other embodiments, the inner tubular member may be provided in a different manner than the outer sleeve.

In some embodiments, providing the inner tubular member further comprises integrally forming the first locking component in an outer wall thereof. For example, the inner tubular member may be produced by injection molding or 3D (three-dimensional) printing having the first locking component formed as part of the outer wall. In other embodiments, providing the inner tubular member further comprises coupling the first locking component to the outer wall by any suitable coupling means.

In some embodiments, providing the outer sleeve further comprises integrally forming the second locking component in an inner wall thereof. For example, the outer sleeve may be produced by injection molding or 3D printing having the second locking component formed as part of the inner wall. In other embodiments, providing the outer sleeve further comprises coupling the second locking component to the inner wall by any suitable coupling means.

In some embodiments, the first locking component comprises a projection and the second locking component comprises a recess that receives the projection. In some embodiments, the recess comprises at least one niche and at least one longitudinal channel. In other embodiments, the first locking component comprises the recess and the second locking component comprises the projection. In other embodiments, the first and second locking components may comprise any other suitable complementary locking components.

In some embodiments, providing the outer sleeve may further comprise providing an inner collar portion at one end thereof that sealingly engages a sealing member. In some embodiments, the method 400 may further comprise providing at least one sealing member. In some embodiments, a first and second sealing member may be provided.

In some embodiments, the method 400 may further comprise engaging at least one outer sleeve with the inner tubular member. The outer sleeve may be engaged with the inner tubular member in the non-expanded position or in one of the expanded positions. In some embodiments, engaging the outer sleeve with the tubular member may comprise sliding the inner tubular member longitudinally into the outer sleeve. In some embodiments, engaging the outer sleeve with the tubular member may further comprise rotating the outer sleeve with respect to the inner tubular member (or vice versa) to interlock the first and second locking components. Interlocking the first and second locking components may secure the outer sleeve to the inner tubular member in the non-expanded position or one of the expanded positions.

In some embodiments, the method 400 may further comprise engaging the first and second sealing members with opposed ends of the sleeve assembly.

Various modifications besides those already described are possible without departing from the concepts disclosed herein. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Although particular embodiments have been shown and described, it will be appreciated by those skilled in the art that various changes and modifications might be made without departing from the scope of the disclosure. The terms and expressions used in the preceding specification have been used herein as terms of description and not of limitation, and there is no intention in the use of such terms and expressions of excluding equivalents of the features shown and described or portions thereof.

The invention claimed is:

1. A sleeve assembly comprising:

an inner tubular member comprising a first locking component;

at least one outer sleeve that telescopically engages the inner tubular member in a non-expanded position and at least one expanded position, the at least one outer sleeve comprising a second locking component that interlocks with the first locking component; and wherein the first and second locking components interlock to secure the at least one outer sleeve in at least one of the non-expanded position and the at least one expanded position, wherein one of the first and second locking components comprises a projection and the other one of the first and second locking components comprises a recess, the projection being received into the recess, and wherein the recess extends radially partially though the inner tubular member or at least one outer sleeve.

2. The sleeve assembly of claim 1, wherein the first locking component comprises the projection and the second locking component comprises the recess.

3. The sleeve assembly of claim 1, wherein the first locking component comprises the recess and the second locking component comprises the projection.

4. The sleeve assembly of claim 1, wherein the recess comprises at least one niche, the projection being received into the at least one niche to interlock the first and second locking components.

5. The sleeve assembly of claim 4, wherein the recess further comprises at least one longitudinal channel interconnected with the at least one niche, and wherein longitudinal movement of the at least one outer sleeve with respect to the inner tubular member slides the projection through the at least one longitudinal channel.

6. The sleeve assembly of claim 5, wherein the at least one longitudinal channel is rotationally offset from the at least one niche such that rotation of the at least one outer sleeve with respect to the inner tubular member displaces the projection between the at least one niche and the at least one longitudinal channel.

7. The sleeve assembly of claim 6, wherein the at least one niche comprises a first niche and a second niche.

8. The sleeve assembly of claim 7, wherein the first niche and the second niche are interconnected by a first longitudinal channel of the at least one longitudinal channel.

9. The sleeve assembly of claim 8, wherein the at least one niche further comprises a third niche.

10. The sleeve assembly of claim 9, wherein the second and third niche are interconnected by a second longitudinal channel of the at least one longitudinal channel.

11. The sleeve assembly of claim 10, wherein the first longitudinal channel is rotationally offset from the second longitudinal channel.

12. The sleeve assembly of claim 1, wherein the inner tubular member is longitudinally reversible with respect to the at least one outer sleeve.

13. The sleeve assembly of claim 1, wherein the at least one outer sleeve comprises a first outer sleeve and a second outer sleeve, the first and second outer sleeves positioned at opposed ends of the inner tubular member.

14. The sleeve assembly of claim 1, further comprising at least one sealing member that engages at least one of the inner tubular member and the at least one outer sleeve.

15. The sleeve assembly of claim 14, wherein the at least one outer sleeve comprises an inner collar portion to sealingly engage the at least one sealing member.

16. A method for making a sleeve assembly, the method comprising:

providing an inner tubular member comprising a first locking component; and providing at least one outer sleeve that telescopically engages the inner tubular member in a non-expanded position and at least one expanded position, the at least one outer sleeve comprising a second locking component that interlocks with the first locking component;

wherein one of the first and second locking components comprises a projection and the other one of the first and second locking components comprises a recess, the projection being receivable into the recess, and wherein the recess extends radially partially through the inner tubular member or the at least one outer sleeve.

17. The method of claim 16, wherein providing the inner tubular member comprises integrally forming the first locking component in an outer wall thereof.

18. The method of claim 16, wherein providing the at least one outer sleeve comprises integrally forming the second locking component in an inner wall thereof.

19. The method of claim 16, further comprising engaging the at least one outer sleeve with the inner tubular member in one of the non-expanded position and the at least one expanded position such that the first and second locking components interlock.

20. A sleeve assembly comprising:

an inner tubular member comprising a first locking component;

at least one outer sleeve that telescopically engages the inner tubular member in a non-expanded position and at least one expanded position, the at least one outer sleeve comprising a second locking component that interlocks with the first locking component;

wherein the first and second locking components interlock to secure the at least one outer sleeve in at least one of the non-expanded position and the at least one expanded position;

wherein one of the first and second locking components comprises a projection and the other one of the first and second locking components comprises a recess, the projection being received into the recess; and wherein the recess further comprises:

a first niche, a second niche, and a third niche that each receive the projection therein to interlock the first and second locking components;

a first longitudinal channel interconnecting the first niche and the second niche, the first longitudinal channel rotationally offset from the first niche and the second niche;

a second longitudinal channel interconnecting the second niche and the third niche, the second longitudinal channel rotationally offset from the second niche and the third niche; and wherein longitudinal movement of the at least one outer sleeve with respect to the inner tubular member slides the projection through the first and second longitudinal channels and wherein rotation of the at least one outer sleeve with respect to the inner tubular member displaces the projection between the first and second longitudinal channels and one of the first, second, and third niches.

* * * * *